US011332986B2

(12) United States Patent
Riise et al.

(10) Patent No.: US 11,332,986 B2
(45) Date of Patent: May 17, 2022

(54) PACKOFF PRESSURE PREVENTION SYSTEMS AND METHODS

(71) Applicant: Halliburton Energy Services, Inc., Houston, TX (US)

(72) Inventors: Henrik Erevik Riise, Stavanger (NO); Helge Rorvik, Sandnes (NO)

(73) Assignee: Halliburton Energy Services, Inc., Houston, TX (US)

( * ) Notice: Subject to any disclaimer, the term of this patent is extended or adjusted under 35 U.S.C. 154(b) by 89 days.

(21) Appl. No.: 15/558,152

(22) PCT Filed: Mar. 16, 2015

(86) PCT No.: PCT/US2015/020830
§ 371 (c)(1),
(2) Date: Sep. 13, 2017

(87) PCT Pub. No.: WO2016/148688
PCT Pub. Date: Sep. 22, 2016

(65) Prior Publication Data

US 2018/0045002 A1 Feb. 15, 2018

(51) Int. Cl.

| | |
|---|---|
| ***E21B 43/12*** | (2006.01) |
| ***E21B 21/08*** | (2006.01) |
| ***E21B 47/06*** | (2012.01) |
| ***E21B 21/10*** | (2006.01) |
| ***E21B 47/017*** | (2012.01) |
| *E21B 44/00* | (2006.01) |

(52) U.S. Cl.
CPC ..... *E21B 21/08* (2013.01); *E21B 21/103* (2013.01); *E21B 47/017* (2020.05); *E21B 47/06* (2013.01); *E21B 44/00* (2013.01)

(58) Field of Classification Search
CPC ..... E21B 21/08; E21B 21/103; E21B 47/011; E21B 47/06; E21B 47/00
See application file for complete search history.

(56) References Cited

U.S. PATENT DOCUMENTS

| | | | | |
|---|---|---|---|---|
| 5,732,776 | A * | 3/1998 | Tubel | E21B 47/12 166/250.15 |
| 5,927,409 | A | 7/1999 | Turner | |
| 6,401,838 | B1 | 6/2002 | Rezmer-Cooper | |
| 9,080,411 | B1 * | 7/2015 | Lugo | E21B 33/064 |
| 2007/0162235 | A1 * | 7/2007 | Zhan | G01V 1/40 702/6 |
| 2009/0166031 | A1 | 7/2009 | Hernandez | |

(Continued)

FOREIGN PATENT DOCUMENTS

WO 2016148688 A1 9/2016

*Primary Examiner* — Abby J Flynn
*Assistant Examiner* — Yanick A Akaragwe
(74) *Attorney, Agent, or Firm* — Benjamin Ford; Parker Justiss, P.C.

(57) ABSTRACT

A packoff pressure prevention system includes an internal pressure sensor to measure fluid pressure within a drillstring. The system further includes an annular vent to, when open, enable fluid to escape from within the drillstring into an annulus. The system further includes a processor coupled to receive pressure measurements from the internal pressure sensor and coupled to signal the annular vent to open if the fluid pressure within the drillstring rises a first threshold amount over a second threshold time.

20 Claims, 4 Drawing Sheets

(56) References Cited

U.S. PATENT DOCUMENTS

| | | | | |
|---|---|---|---|---|
| 2009/0272580 | A1 | 11/2009 | Dolman et al. | |
| 2013/0090854 | A1 | 4/2013 | Rasmus | |
| 2016/0273298 | A1* | 9/2016 | Vasques | E21B 33/1208 |

* cited by examiner

PACKOFF PRESSURE PREVENTION SYSTEMS AND METHODS

CROSS-REFERENCE TO RELATED APPLICATION

This application is the National Stage of, and therefore claims the benefit of, International Application No. PCT/US2015/020830 filed on Mar. 16, 2015, entitled "PACKOFF PRESSURE PREVENTION SYSTEMS AND METHODS," which was published in English under International Publication Number WO 2016/148688 on Sep. 22, 2016. The above application is commonly assigned with this National Stage application and is incorporated herein by reference in its entirety.

BACKGROUND

During the drilling process, a drill bit removes earth from the end of the wellbore thus creating cuttings that must be removed from the wellbore. The drilling assembly provides a drilling fluid stream to flush the cuttings away from the bit and transport them to a retention pond on the surface. However, a portion of the cuttings may be insufficiently buoyed by the fluid stream, causing them to remain within the wellbore, settling in regions having relatively small stream velocities. These cuttings may accumulate and create a bed on the bottom surface of the wellbore. The size of this bed may vary due to a variety of factors such as the flow rate of the drilling fluid stream, the geometry of the wellbore, the geometry of the drilling assembly, the size of the cuttings, the density of the cuttings, the viscosity of the drilling fluid, and the orientation of the wellbore.

Although cuttings accumulations can occur in both vertical and horizontal wellbores, cuttings beds are more common in horizontal or highly inclined wellbores due to the tendency of the cuttings to settle to the bottom surface of the wellbore and the tendency for the drilling fluid to flow near the upper surface of the wellbore. Motion of the drilling assembly (e.g., removal from the wellbore) often pushes the cuttings around, leading to the creation of cuttings dunes, which further modify the pattern of the flow stream and increase the likelihood of a flow blockage.

Such blockages are termed "packoff" events, and they often serve as a prelude to a stuck drilling assembly that is challenging or impossible to remove from the wellbore. A packoff event may also occur when the formation surrounding a drillstring collapses. Such a collapse may occur due to insufficient pressure against wellbore wall or a decrease in integrity of the surrounding formation.

When a packoff event occurs, there is a sudden reduction or loss of the ability to circulate drilling fluid, often accompanied by large transients in annular pressure that may damage fragile formations and cause further borehole collapse. If prompt remedial action is not taken, the pipe may become stuck, which may prevent removal of the drilling assembly from the wellbore. The packoff event may result in abandonment of at least a portion of the wellbore, require drilling a new section of the wellbore adjacent to the packoff location, and/or result in abandonment of the bottomhole assembly in the packoff region of the wellbore, any of which may substantially increase the costs associated with and time needed to complete the drilling operation.

BRIEF DESCRIPTION OF THE DRAWINGS

Accordingly, there are disclosed herein certain apparatuses, systems, and methods for preventing packoff pressure transients. In the following detailed description of the various disclosed embodiments, reference will be made to the accompanying drawings in which.

Figure 1:
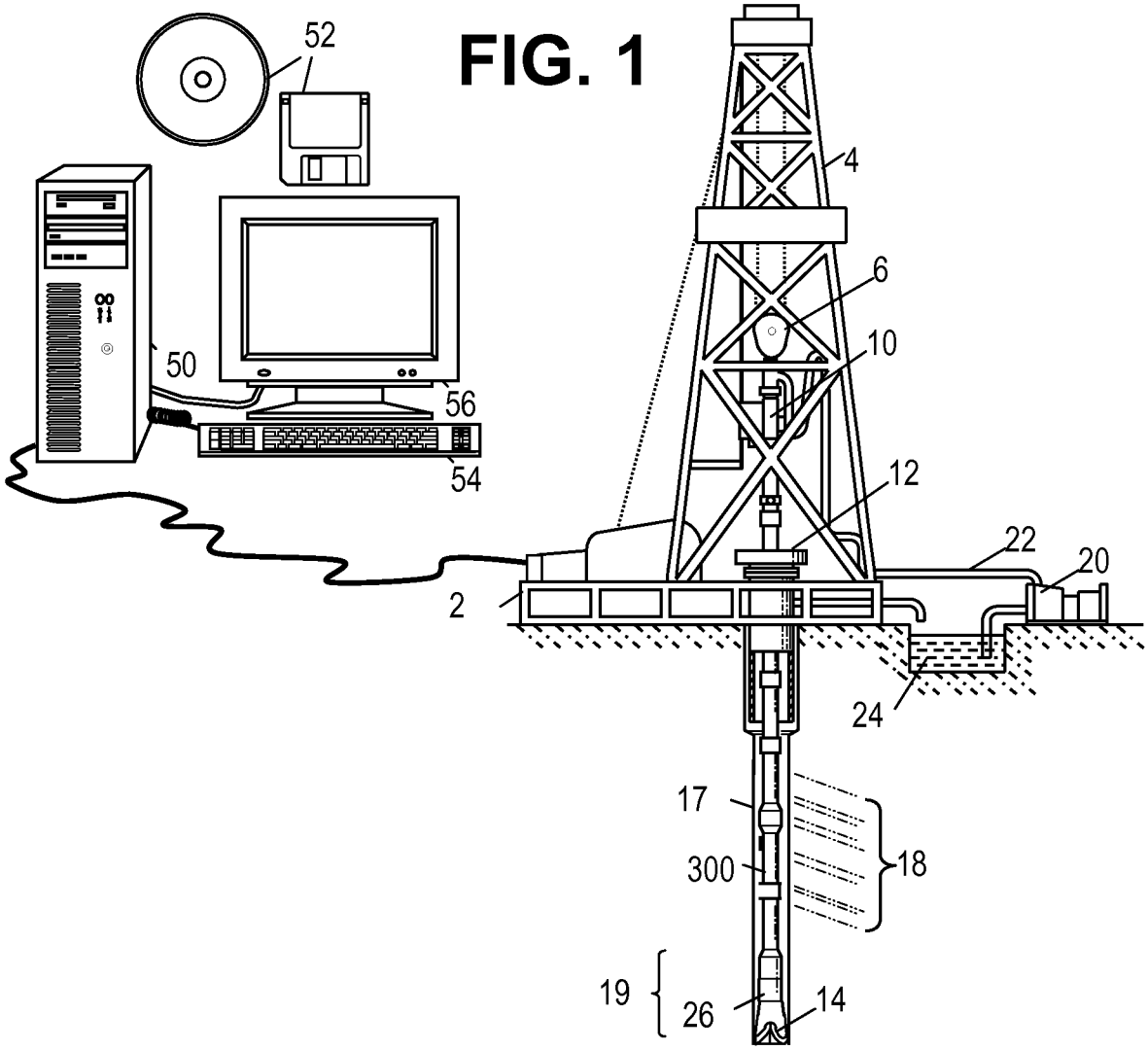
FIG. 1 is a contextual view of an illustrative drilling environment.

It should be understood, however, that the specific embodiments given in the drawings and detailed description thereto do not limit the disclosure. On the contrary, they provide the foundation for one of ordinary skill to discern the alternative forms, equivalents, and modifications that are encompassed together with one or more of the given embodiments in the scope of the appended claims.

NOTATION AND NOMENCLATURE

Certain terms are used throughout the following description and claims to refer to particular system components and configurations. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ". Also, the term "couple" or "couples" is intended to mean either an indirect or a direct electrical or physical connection. Thus, if a first device couples to a second device, that connection may be through a direct electrical connection, through an indirect electrical connection via other devices and connections, through a direct physical connection, or through an indirect physical connection via other devices and connections in various embodiments.

DETAILED DESCRIPTION

The issues identified in the background are at least partly addressed by packoff pressure prevention systems and methods that limit pressure transients and thereby mitigate the formation damage that might otherwise result from a packoff event. FIG. 1 shows an illustrative drilling environment in which packoff pressure transients may be prevented. A drilling platform 2 supports a derrick 4 having a traveling block 6 for raising and lowering a bottomhole assembly (BHA) 19. The platform 2 may also be located offshore for subsea drilling purposes in at least one embodiment. The BHA 19 may include one or more of a rotary steerable system, logging while drilling system, drill bit 14, and downhole motor 26. A top drive 10 supports and rotates the BHA 19 as it is lowered through the wellhead 12. The drill bit 14 may also be driven by the downhole motor 26. As the drill bit 14 rotates, it creates a wellbore 17 that passes through various formations 18. A pump 20 circulates drilling fluid 24 through a feed pipe 22, through the interior of the drillstring to the drill bit 14. The fluid exits through orifices in the drill bit 14 and flows upward to transport cuttings to the surface where the fluid is filtered and recirculated. The drillstring may also include a packoff prevention sub 300, described in detail with respect to FIG. 3.

A data processing system 50 may be coupled to a measurement unit on the platform 2, and may periodically obtain data from the measurement unit as a function of position and/or time. Software (represented by information storage media 52) may run on the data processing system 50 to collect the data and organize it in a file or database. The software may respond to user input via a keyboard 54 or other input mechanism to display data as an image or movie on a monitor 56 or other output mechanism.

Figure 2:
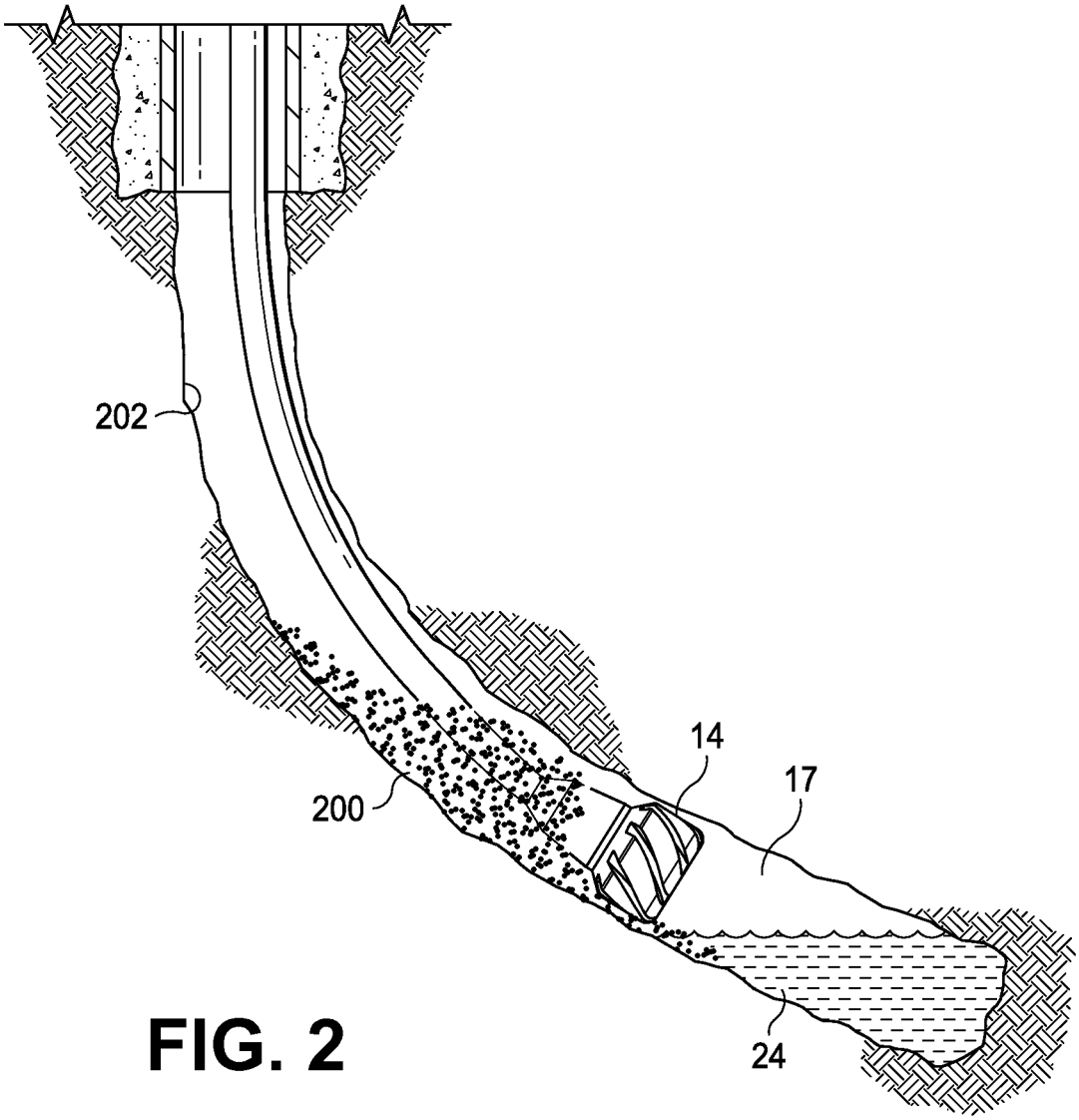
FIG. 2 is a cross-sectional view of an illustrative packoff event.

FIG. 2 illustrates a packoff event within the borehole 17. Cuttings 200 have accumulated within the wellbore 17 above the drill bit 14, causing the pipe to become stuck within the wellbore 17. Additionally, the cuttings 200 substantially slow or prevent the drilling fluid 24 from flowing up the annulus 202 of the wellbore 17 after exiting the drill bit 14. As such, fluid pressure within the drillstring and in the wellbore region below the packoff event sharply increases. Additionally, fluid pressure in the annulus 202 above the packoff event decreases. The pressure spike within the drillstring may occur rapidly, giving workers scant time to recognize the spike and implement a response before irreversible damage occurs. Additionally, the pressure spike may cause pressure sensitive tools below the packoff location to deploy, creating additional problems for workers to address. For example, a reamer near the bit 14 may deploy in the high pressure environment caused by the packoff event. Consequently, workers may be required to disengage the reamer before moving the drillstring or bottomhole assembly in response to the pressure spike.

Figure 3:
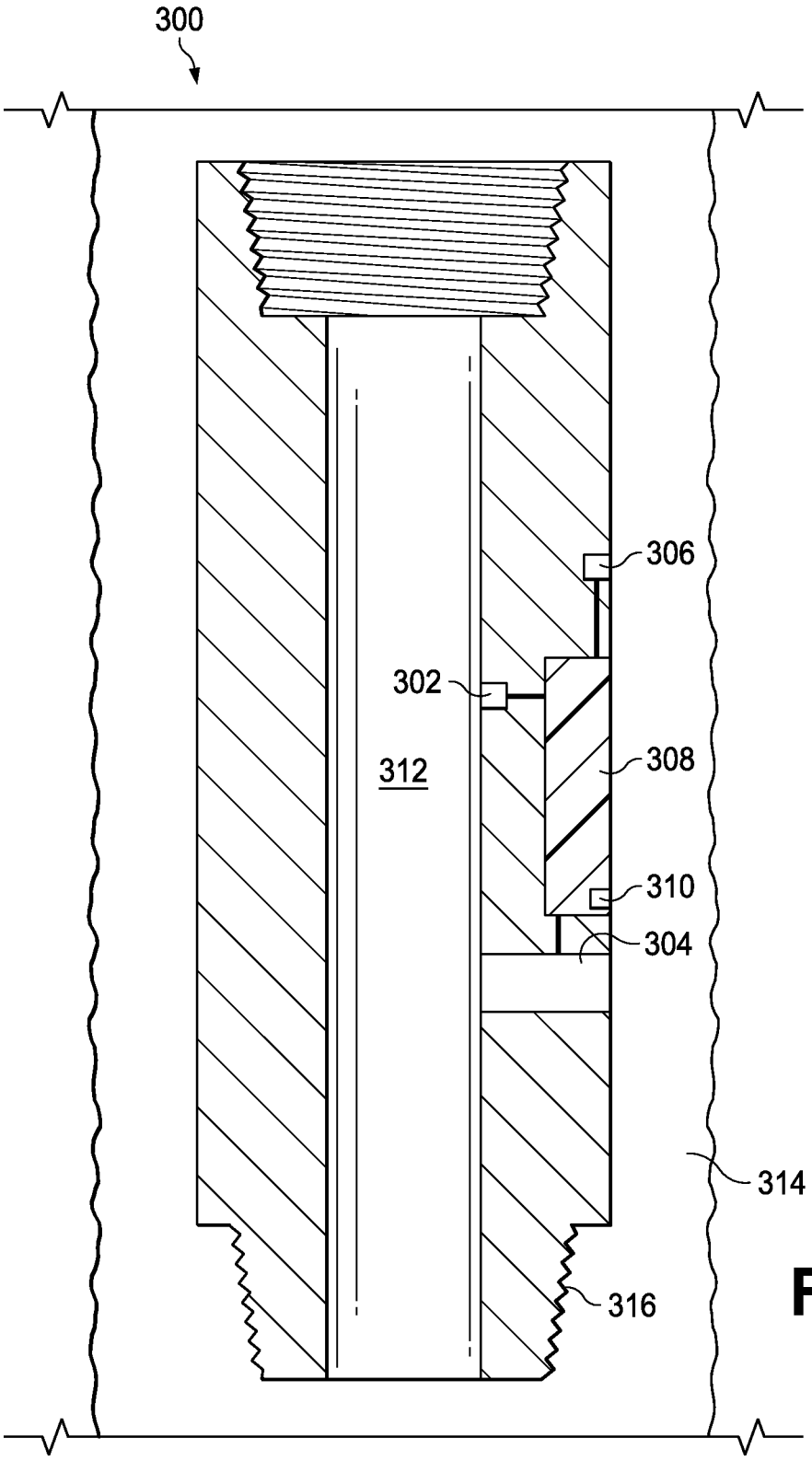
FIG. 3 is a cross-sectional view of an illustrative packoff prevention sub.

FIG. 3 is a cross-sectional view of an illustrative packoff prevention sub 300 that operates to prevent such packoff-induced pressure transients. The sub 300 has a tubular shape, and may include a threaded connector 316 at one or both ends to couple with other portions of the drillstring. In this way, one or more subs 300 may be placed along any desired portion of the drillstring, including above portions of the drillstring that may be prone to packoff events. The sub 300 includes an internal pressure sensor 302, a processor 308, and an annular vent 304. The internal pressure sensor 302 measures fluid pressure within the drillstring 312. For example, the fluid may be drilling fluid during drilling operations. The internal pressure sensor 302 may be incorporated into the same package as the processor 308 or may be coupled to an external processor 308 as illustrated.

The annular vent 304, when open, enables fluid to escape from within the drillstring 312 into the annulus 314. The annular vent 304 may be implemented as a valve, choke, gate and seal device, and the like. In at least one embodiment, the annular 304 vent only enables fluids to pass in one direction: from within the drillstring 312 into the annulus 314. In other embodiments, the annular vent 304 enables fluids to pass only in the opposite direction or in both directions.

The processor 308 obtains input from the internal pressure sensor 302, sends output to the annular vent 304, and may signal the annular vent 304 to open if the fluid pressure within the drillstring 312 rises a first threshold amount over a second threshold time. For example, the annular vent 304 may open if the fluid pressure rises 400 psi over 10 seconds. These and other thresholds are adjustable and programmable, and the thresholds may be used in combinations as desired. For example, in addition to the 400 psi over 10 second thresholds, the annular vent 304 may also open if the fluid pressure rises 100 psi over 2 seconds. In this way, a complex series of rules may be created using Boolean logic to finely control the opening of the annular vent 304 based on variables obtained or derived by the processor 308. These rules may be incorporated into rule sets that apply only when particular liquids are present within the drillstring.

The first and second threshold may characterize a pressure spike caused by a packoff event. When the annular vent 304 is opened, fluid escapes from within the drillstring 312 and enters the annulus 314, which is under relatively lower pressure. As such, the annular vent 304 is preferably positioned above the packoff event. By enabling the fluid to escape, the pressure within the drillstring 312 is reduced. Additionally, the rules may incorporate pressure thresholds such as a threshold pressure set below a pressure at which a pressure-sensitive tool deploys. As such, when the annular vent 304 is above the pressure-sensitive tool on the drillstring, the pressure-sensitive tool will not deploy because of the reduction in pressure caused by the annular vent 304. Accordingly, workers have more time to respond to the packoff event before irreversible damage occurs. In some cases, the pressure spike is completely reduced resulting in significant time and resource savings.

Additionally, rules may also be created for closing the annular vent 304. For example, the processor 308 may signal the annular vent 304 to close after fixed amount of time elapses from when the processor 30 signaled the annular vent 304 to open. Additionally, the annular vent 304 may close once the fluid pressure within the drillstring 312 falls under a certain threshold. As described above, these rules may be combined and formed into rule sets as desired to finely control the closing of the annular vent 304 based on variables obtained or derived by the processor 308.

The sub 300 also includes an annulus pressure sensor 306 to measure fluid pressure within the annulus 314. The annulus pressure sensor 306 may be placed such that it is above a packoff event. As such, during and after a packoff event, the processor 308 may obtain input from the annulus pressure sensor 306 and calculate a pressure difference between pressure within the drillstring 312 and pressure within the annulus 314. The input from the annulus pressure sensor 306 and derived measurements such as the pressure difference may be used as variables in the creation of the rules for opening and closing the annular vent 304 described above. For example, the processor 308 may signal the annular vent 304 to open if the fluid pressure within the drillstring 312 rises a first threshold amount over a second threshold time and if the pressure difference is above a third threshold amount. As another example, the annular vent 304 may close if the pressure difference falls below a fourth threshold amount.

The processor 308 may be accessed through a programming port 310, which may accommodate a wired or wireless connection, and the processor may be coupled to memory that stores the rules described above. Although FIG. 3 has been illustrated and described as one sub 300, in at least one embodiment the elements of the sub 300 may be distributed as a system along multiple subs, along the bottomhole assembly, or along the drillstring. For example, multiple internal pressure sensors 302 distributed along the drillstring may be included in a packoff pressure prevention system. As another example, multiple annulus pressure sensors 306 distributed along the drillstring may be included in such a system. Similarly, multiple processors 308 and annular vents 304 may be included in such a system to provide venting capabilities at multiple points in the drillstring. In various embodiments, such annular vents 304 may operate in conjunction and under common control, or may be operated or controlled separately as desired.

Figure 4:
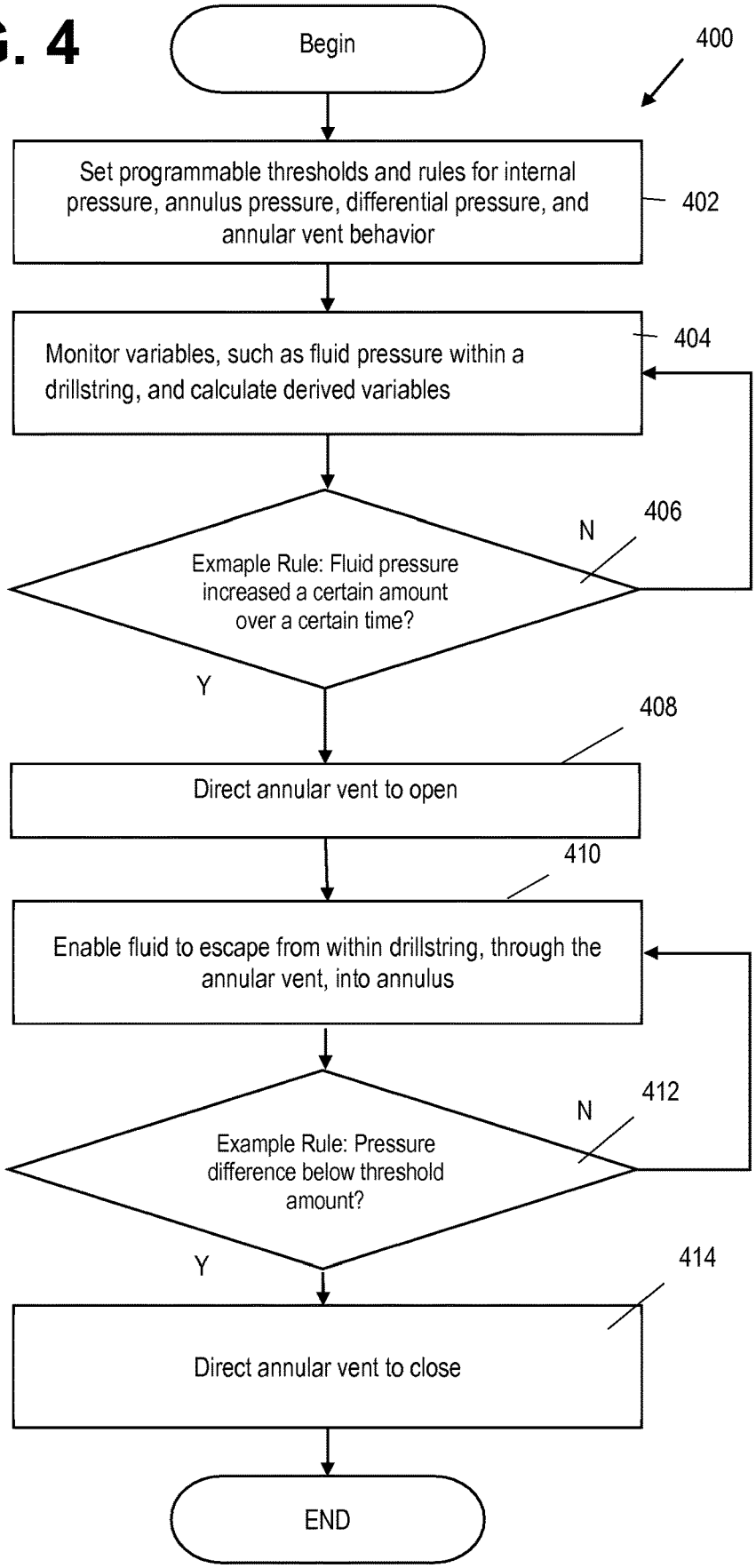
FIG. 4 is a flow diagram of an illustrative packoff prevention method.

FIG. 4 is a flow diagram of an illustrative method 400 of preventing packoff pressure. At 402, the thresholds for the internal pressure sensor, annulus pressure sensor, and differential pressure are programmed. Additionally, rules may be created regarding the opening and closing of the annular vent based on combinations of these thresholds and other thresholds of other variables as desired. These rules may be stored as software in memory accessible by the processor. At 404, the variables, such as fluid pressure within the drillstring, are monitored, and some variables may be derived or calculated. Specifically, the fluid pressure within the drillstring, fluid pressure within the annulus, and differential pressure are measured or calculated. At 406, this data is compared against the thresholds and rules. One of the many possible rules is illustrated. Specifically, the data obtained from the internal pressure sensor is evaluated to determine if the fluid pressure within the drillstring has increased a first threshold amount over a second threshold time. If not, monitoring of the variables continues at 404. If so, at 408 the annular vent is directed to open. For example, a processor may send a signal to the annular vent directing the vent to open. At 410, fluid is enabled to escape from within the drillstring, through the annular vent, and into the annulus. As such, the pressure within the drillstring is reduced. At 412, updated data is compared to the thresholds and rules. One of the many possible rules is illustrated. Specifically, if the pressure difference between from within the drillstring and within the annulus falls below a threshold amount, the processor may signal the annular vent to close at 414. If not, fluid may continue to escape at 410 until the threshold is achieved. Any of the thresholds may be adjusted as desired.

A packoff pressure prevention system includes an internal pressure sensor to measure fluid pressure within a drillstring. The system further includes an annular vent to, when open, enable fluid to escape from within the drillstring into an annulus. The system further includes a processor coupled to receive pressure measurements from the internal pressure sensor and coupled to signal the annular vent to open if the fluid pressure within the drillstring rises a first threshold amount over a second threshold time.

The system may include an annulus pressure sensor to measure fluid pressure within the annulus. The processor may be coupled to receive annular pressure measurements from the annulus pressure sensor for calculating a pressure difference between pressure in the drillstring and pressure in the annulus. The processor may signal the annular vent to open if the fluid pressure within the drillstring rises the first threshold amount over the second threshold time and if the pressure difference is above a third threshold amount. The processor may signal the annular vent to close if the pressure difference falls below a fourth threshold amount. The processor may signal the annular vent to close if the fluid pressure within the drillstring falls below a fifth threshold amount. The first threshold and the second threshold may be programmable.

A method of preventing packoff pressure includes monitoring fluid pressure within a drillstring. The method further includes directing, if the fluid pressure within the drillstring rises a first threshold amount over a second threshold time, an annular vent to open. The method further includes enabling fluid to escape from within the drillstring, through the annular vent, into an annulus.

The method may further include measuring fluid pressure within the annulus. The method may further include calculating a pressure difference between pressure in the drillstring and pressure in the annulus. The method may further include directing the annular vent to open if the fluid pressure within the drillstring rises the first threshold amount over the second threshold time and if the pressure difference is above a third threshold amount. The method may further include directing the annular vent to close if the pressure difference falls below a fourth threshold amount. The method may further include adjusting the first threshold and the second threshold.

A packoff pressure prevention sub includes an internal pressure sensor to measure fluid pressure within a drillstring. The sub further includes an annular vent to, when open, enable fluid to escape from within the drillstring into an annulus. The sub further includes an annulus pressure sensor to measure fluid pressure within the annulus. The sub further includes a processor coupled to receive pressure measurements from the internal pressure sensor and coupled to signal the annular vent to open if the fluid pressure within the drillstring rises a first threshold amount over a second threshold time and if a pressure difference between the fluid pressure within the drillstring and fluid pressure within the annulus is above a third threshold amount.

The processor may signal the annular vent to close if the pressure difference falls below a fourth threshold amount. The processor may signal the annular vent to close if the fluid pressure within the drillstring falls below a fifth threshold amount. The first threshold, the second threshold, and the third threshold may be programmable.

A system of preventing unintentional deployment of a pressure sensitive tool includes a pressure sensitive tool. The system further includes a safeguard sub coupled to the pressure sensitive tool, the safeguard sub including an internal pressure sensor to measure fluid pressure within a drillstring. The sub further includes an annular vent above the pressure sensitive tool to, when open, enable fluid to escape from within the drillstring into an annulus, thus decreasing pressure on the pressure sensitive tool. The sub further includes a processor coupled to receive input at least from the internal pressure sensor, send output at least to the annular vent, and signal the annular vent to open if the fluid pressure within the drillstring rises above first threshold amount.

The pressure sensitive tool may be a reamer. The first threshold may be less than the pressure at which the pressure sensitive tool deploys.

While the present disclosure has been described with respect to a limited number of embodiments, those skilled in the art will appreciate numerous modifications and variations therefrom. It is intended that the appended claims cover all such modifications and variations.

What is claimed is:

1. A packoff pressure prevention system, comprising: a packoff prevention sub;

an internal pressure sensor located in the packoff prevention sub to measure fluid pressure within a drillstring;

a one-way annular vent located in the packoff prevention sub to, when open, enable fluid to escape from within the drillstring into an annulus, but not avow fluids to pass from the annulus to the drillstring; and a processor located in the packoff prevention sub to receive pressure measurements from the internal pressure sensor, determine if the fluid pressure within the drillstring rises a first threshold amount over a second threshold time, and signal the annular vent to open based upon a determination that the fluid pressure within the drillstring rises to the first threshold amount over the second threshold time.

2. The system of claim 1, further comprising an annulus pressure sensor located in the packoff prevention sub to measure fluid pressure within the annulus.

3. The system of claim 2, wherein the processor is operable to receive annular pressure measurements from the annulus pressure sensor for calculating a pressure difference between pressure in the drillstring and pressure in the annulus.

4. The system of claim 3, wherein the processor signals the annular vent to open if the fluid pressure within the drillstring rises the first threshold amount over the second threshold time and if the pressure difference is above a third threshold amount.

5. The system of claim 3, wherein the processor signals the annular vent to close if the pressure difference falls below a fourth threshold amount.

6. The system of claim 1, wherein the processor signals the annular vent to close if the fluid pressure within the drillstring falls below a fifth threshold amount.

7. The system of claim 1, wherein the first threshold and the second threshold are programmable.

8. A method of preventing packoff pressure, comprising:

monitoring fluid pressure within a drillstring using an internal pressure sensor, a one-way annular vent and a processor located in a packoff prevention sub;

directing, if the fluid pressure within the drillstring rises a first threshold amount over a second threshold time, the annular vent to open; and enabling fluid to escape from within the drillstring, through the annular vent, into an annulus, the annular vent not allowing fluids to pass from the annulus to the drillstring.

9. The method of claim 8, further comprising measuring fluid pressure within the annulus using an annulus pressure sensor located in the packoff prevention sub.

10. The method of claim 9, further comprising calculating a pressure difference between pressure in the drillstring and pressure in the annulus.

11. The method of claim 10, further comprising directing the annular vent to open if the fluid pressure within the drillstring rises the first threshold amount over the second threshold time and if the pressure difference is above a third threshold amount.

12. The method of claim 10, further comprising signaling the annular vent to close if the pressure difference falls below a fourth threshold amount.

13. The method of claim 8, further comprising adjusting the first threshold and the second threshold.

14. A packoff pressure prevention sub, comprising:

an internal pressure sensor to measure fluid pressure within a drillstring;

a one-way annular vent to, when open, enable fluid to escape from within the drillstring into an annulus, but not allow fluids to pass from the annulus to the drillstring;

an annulus pressure sensor to measure fluid pressure within the annulus, a processor coupled to receive pressure measurements from the internal pressure sensor and the annulus pressure sensor, determine if the fluid pressure within the drillstring rises a first threshold amount over a second threshold time and if a pressure difference between the fluid pressure within the drillstring and fluid pressure within the annulus is above a third threshold amount, and signal the annular vent to open based upon a determination that the fluid pressure within the drillstring rises to the first threshold amount over the second threshold time and the pressure difference between the fluid pressure within the drillstring and fluid pressure within the annulus is above the third threshold amount.

15. The sub of claim 14, wherein the processor signals the annular vent to close if the pressure difference falls below a fourth threshold amount.

16. The sub of claim 14, wherein the processor signals the annular vent to close if the fluid pressure within the drillstring falls below a fifth threshold amount.

17. The sub of claim 14, wherein the first threshold, the second threshold, and the third threshold are programmable.

18. A system of preventing unintentional deployment of a pressure sensitive tool, comprising:

a pressure sensitive tool; and a safeguard sub coupled to the pressure sensitive tool, the safeguard sub comprising:

an internal pressure sensor to measure fluid pressure within a drillstring;

a one-way annular vent above the pressure sensitive tool to, when open, enable fluid to escape from within the drillstring into an annulus, thus decreasing pressure on the pressure sensitive tool, but not allow fluids to pass from the annulus to the drillstring; and a processor coupled to receive input at least from the internal pressure sensor, determine if the fluid pressure within the drillstring rises a first threshold amount over a second threshold time, and signal the annular vent to open if the fluid pressure within the drillstring rises the first threshold amount over the second threshold time.

19. The system of claim 18, wherein the pressure sensitive tool is a reamer.

20. The system of claim 18, wherein the first threshold is less than a pressure at which the pressure sensitive tool deploys.

* * * * *